US006755024B1

(12) United States Patent
Mao et al.

(10) Patent No.: US 6,755,024 B1
(45) Date of Patent: Jun. 29, 2004

(54) MULTIPLEX INJECTOR

(75) Inventors: Chien-Pei Mao, Clive, IA (US); John Earl Short, Norwalk, IA (US); Neal A. Thomson, Johnston, IA (US)

(73) Assignee: Delavan Inc., Wilmington, DE (US)

( * ) Notice: Subject to any disclaimer, the term of this patent is extended or adjusted under 35 U.S.C. 154(b) by 0 days.

(21) Appl. No.: 09/935,928

(22) Filed: Aug. 23, 2001

(51) Int. Cl.[7] ..... F02C 7/26; F02C 1/00

(52) U.S. Cl. ..... 60/776; 60/739; 60/740; 60/742; 60/748; 60/800; 239/416; 239/416.5

(58) Field of Search ..... 60/776, 39.463, 60/739, 740, 742, 748, 800; 239/407, 413, 416, 416.4, 416.5

(56) References Cited

U.S. PATENT DOCUMENTS

| | | | | |
|---|---|---|---|---|
| 2,250,079 A | | 7/1941 | McDonald | |
| 4,742,685 A | * | 5/1988 | Halvorsen et al. | 60/739 |
| 4,773,596 A | | 9/1988 | Wright et al. | |
| 4,833,878 A | * | 5/1989 | Sood et al. | 60/778 |
| 4,966,001 A | | 10/1990 | Beebe | |
| 5,224,333 A | | 7/1993 | Bretz et al. | |
| 5,339,635 A | * | 8/1994 | Iwai et al. | 60/733 |
| 5,570,580 A | * | 11/1996 | Mains | 60/747 |
| 5,836,163 A | | 11/1998 | Lockyer et al. | |
| 5,987,875 A | | 11/1999 | Hilburn et al. | |
| 6,016,969 A | | 1/2000 | Tilton et al. | |
| 6,122,916 A | * | 9/2000 | Amos et al. | 60/747 |
| 6,199,367 B1 | * | 3/2001 | Howell | 60/39.23 |
| 6,272,840 B1 | | 8/2001 | Crocker et al. | |
| 6,351,948 B1 | * | 3/2002 | Goeddeke | 60/740 |
| 6,434,945 B1 | * | 8/2002 | Mandai et al. | 60/740 |
| 6,460,340 B1 | * | 10/2002 | Chauvette et al. | 60/740 |
| 6,460,344 B1 | * | 10/2002 | Steinthorsson et al. | 60/776 |
| 6,474,071 B1 | | 11/2002 | Durbin et al. | |

FOREIGN PATENT DOCUMENTS

| | | | |
|---|---|---|---|
| EP | 0924460 | * | 6/1993 |
| WO | 98/55800 | | 12/1998 |
| WO | 99/19670 | | 4/1999 |

OTHER PUBLICATIONS

Tacina, R.R., "*Ignition of Lean Fuel–Air Mixtures in a Premixing–Prevaporizing Duct at Temperatures up to 1000 K*" (Dec. 1980).

Tacina, R.R., "*Autoignition in a Premixing–Prevaporizing Fuel Duct Using Three Different Fuel Injection Systems at Inlet Air Temperatures to 1250 K*" (May 1983).

Rink, K.K., et al., "*The Influeneces of Fuel Composition and Spray Characteristics on Nitric Oxide Formation,*" *Combust. Sci. and Tech.*, vol. 68, pp. 1–14 (Nov. 1989).

Benjamin, M.A., "*Fuel Atomization for Next–Generation Gas Turbine Combustors,*" *Atomization and Sprays*, vol. 10, pp. 427–438 (2000).

Lefebvre, A., "*Fifty Years of Gas Turbine Fuel Injection,*" *Atomization and Sprays*, vol. 10, pp. 251–276 (2000).

* cited by examiner

*Primary Examiner*—Charles G. Freay
(74) *Attorney, Agent, or Firm*—Thompson Hine LLP

(57) ABSTRACT

A multiplex injector system comprising an injector head, a first fuel path located in the injector head, and a first set of injector tips located in the injector head and in fluid communication with the first fuel path. The first set of injector tips includes at least one first injector tip. The multiplex injector further includes a second fuel path located in the injector head and a second set of injector tips located in the injector head and in fluid communication with the second fuel path. The second set of injector tips includes at least one second injector tip. A flow of fuel in each of the first and second fuel paths can be selectively controlled to control the flow of fuel through the first and second sets of injector tips.

53 Claims, 12 Drawing Sheets

MULTIPLEX INJECTOR

The present invention is directed to a multiplex injector, and more particularly, to a multiplex injector having a plurality of injector tips that can be selectively controlled.

BACKGROUND OF THE INVENTION

In aircraft and other engines, fuel injectors are typically used to inject fuel in a spray or atomized form into a combustion chamber of the engine. The atomized air/fuel mixture is then compressed and combusted to create the energy required to provide the engine output and sustain engine operations. Many existing engines have fixed geometry injector systems that include a plurality of injector tips that are commonly controlled to inject fuel into the combustion chamber. For example, fixed geometry injectors such as pressure swirl and air blast atomizer designs are used in aircraft, marine and industrial gas turbines. In such fixed geometry injector systems, the injectors are typically maintained in a "fully open" status during all stages of engine operations. Such conventional fixed geometry injector systems lack the ability to adapt to varying conditions of engine operations, which can lead to relatively high emissions and systems that lack combustion stability during certain operating conditions of the engine.

For example, pure air blast atomizers are often used as injectors and provide acceptable performance at high power conditions. However, such air blast atomizers may not provide adequate performance during start-up and low power engine conditions. Simplex air blast atomizers, such as that disclosed in U.S. Pat. No. 5,224,333 to Bretz et al., the contents of which are hereby incorporated by reference, may also perform acceptably at high power engine conditions, but may not provide sufficient mixing or sufficiently low emission levels at high power conditions.

Variable geometry injectors have also been used in an attempt to provide an injector system that can adapt to various engine conditions. However, such variable geometry injectors may include moving parts that can become clogged or stuck due to heat stress or carbon deposits formed in the injector system. Accordingly, there is a need for a robust injector system that can be dynamically controlled to adapt the injector system to varying engine conditions.

SUMMARY OF THE INVENTION

The present invention is a multiplex injector that is robust and provides a variable, controllable output spray. More particularly, the multiplex injector includes at least a first and a second set of injector tips, and fuel can be selectively routed to the first and second sets of injector tips to control the volume and pattern of fuel sprayed by the injector. The multiplex injector may include nearly any number of sets of injector tips that can be controlled in nearly any desired manner to achieve the desired performance.

In one embodiment, the invention is a multiplex injector system comprising an injector head, a first fuel path located in the injector head, and a first set of injector tips located in the injector head and in fluid communication with the first fuel path. The first set of injector tips includes at least one first injector tip. The multiplex injector further includes a second fuel path located in the injector head and a second set of injector tips located in the injector head and in fluid communication with the second fuel path. The second set of injector tips includes at least one second injector tip. A flow of fuel in each of the first and second fuel paths can be selectively controlled to control the flow of fuel through the first and second sets of injector tips.

Other objects and advantages of the present invention will be apparent from the following description and the accompanying drawings.

DETAILED DESCRIPTION

Figure 1:
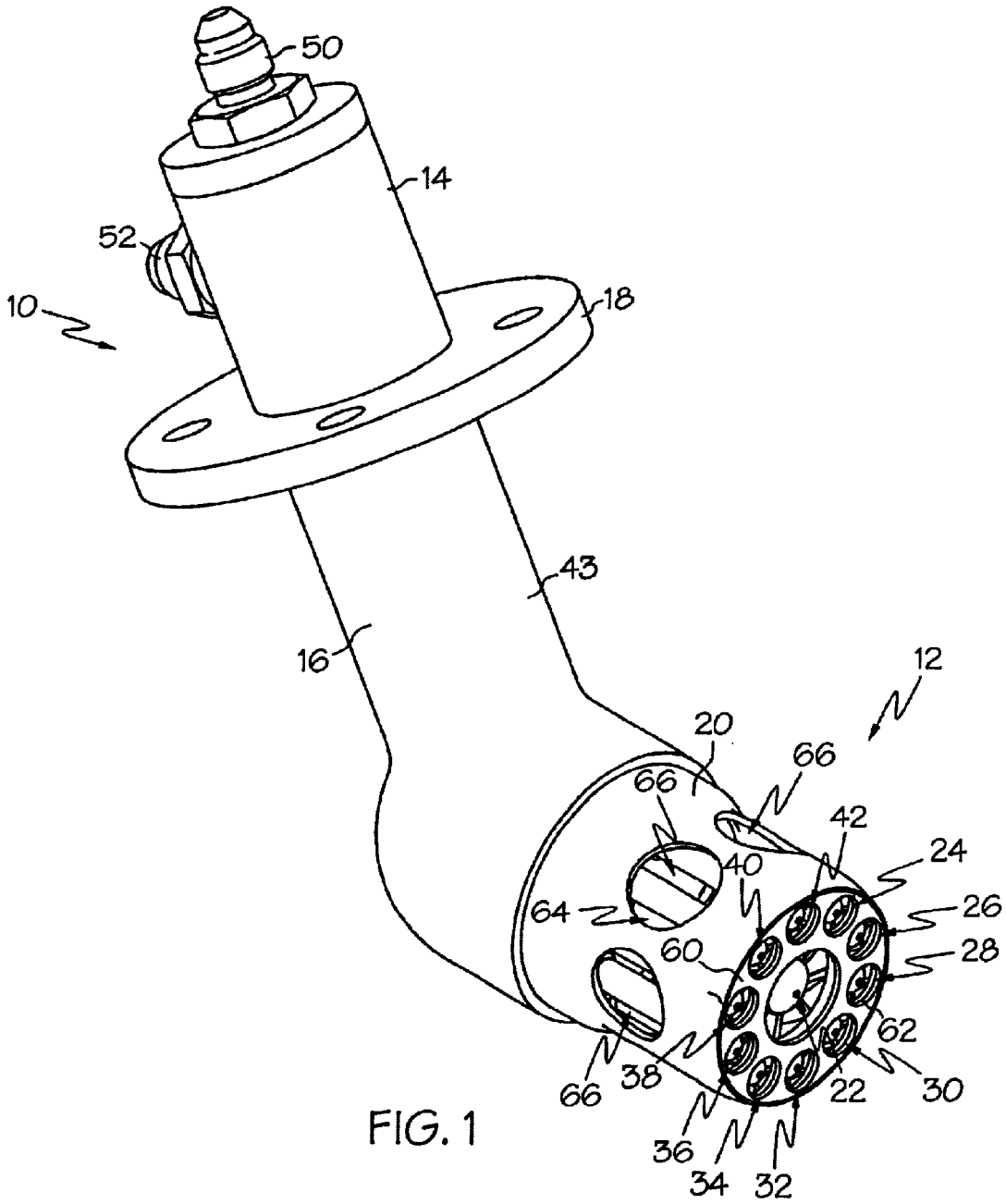
FIG. 1 is a front perspective view of one embodiment of the multiplex injector of the present invention.

As shown in FIG. 1, the multiplex injector of the present invention, generally designated 10, includes a body or injector head 12, an upper housing 14, a strut or throat portion 16 located below and coupled to the upper housing 14, and a mounting flange 18 located between and coupled to the upper housing 14 and strut 16. The multiplex injector 10 includes a sheath 20 coupled to a lower end of the strut 16, and a plurality of injector tips 22, 24, 26, 28, 30, 32, 34, 36, 38, 40,42 are located radially inside the sheath 20. The injector head 12 may include the sheath 20. The multiplex injector 10 may include a relatively large central injector tip 22 and a plurality of smaller injector tips 24, 26, 28, 30, 32, 34, 36, 38, 40, 42 located about the central injector tip 22 and arranged in a generally circular pattern. The shape and size of the injector tips can vary, and may have a diameter of between about 0.3" and about 1.5".

Figure 2:
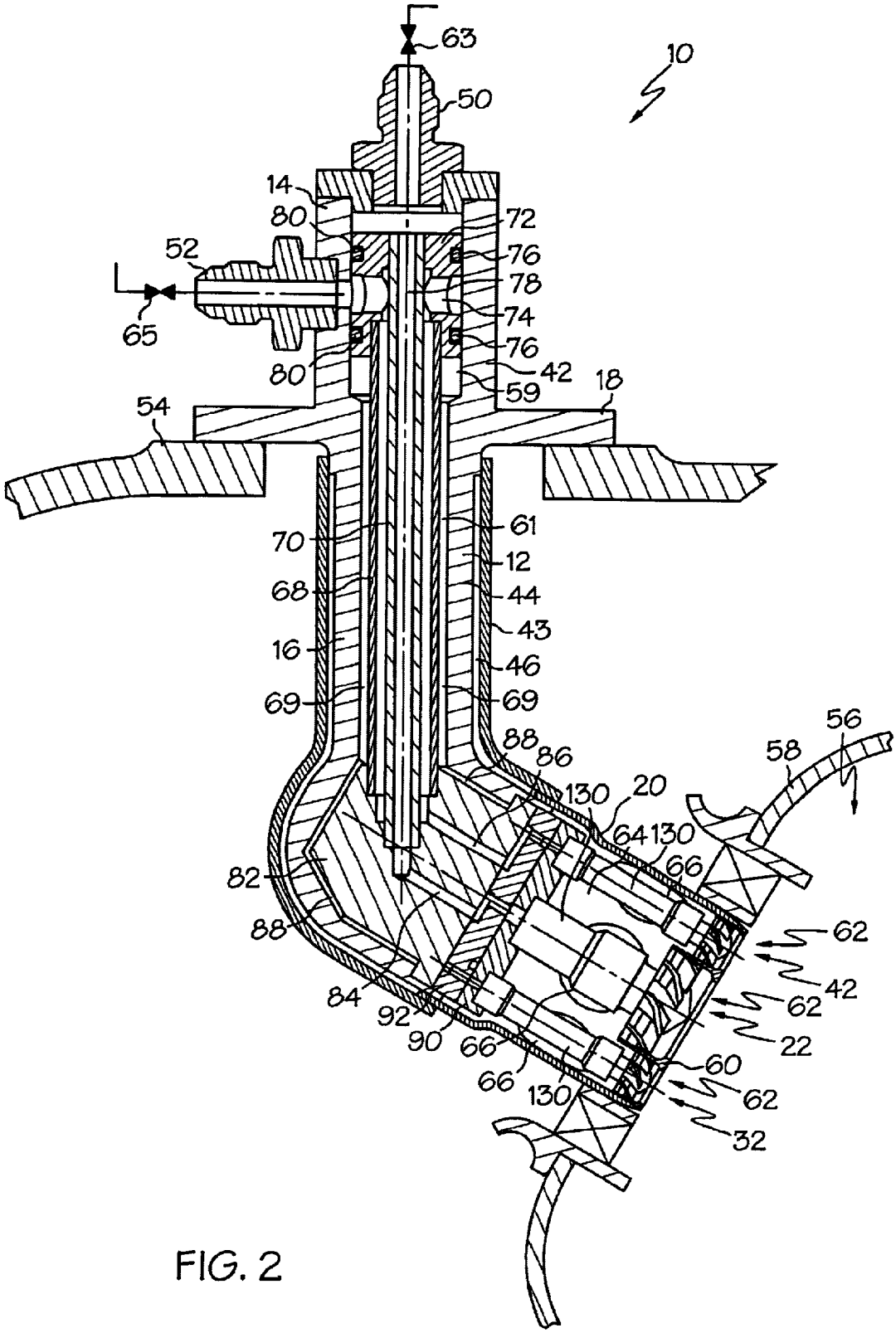
FIG. 2 is a side cross section of the injector of FIG. 1, shown coupled to an engine mount.

The strut 16 may include an outer casing 43 and an inner portion 44 (see FIG. 2). The outer casing 43 is located generally around the inner portion 44 of the strut 16, and is generally spaced apart from the inner portion 44 such that an annular insulating air gap 46 is formed between the outer casing 43 and the inner portion 44.

The multiplex injector 10 further includes a pair of input ports 50, 52 coupled to the upper housing 14. As shown in FIG. 2, the multiplex injector 10 can be mounted to an engine mount, generally designated 54, such that the injector tips 22, 24, 26, 28, 30, 32, 34, 36, 38, 40, 42 can inject or spray fuel into the inner volume or combustion chamber 56 of a combustion liner 58, as will be described in greater detail below.

The sheath 20 is coupled to the strut 16, such as by inserting an inner edge of the sheath 20 in the gap 46 formed between the outer casing 43 and the inner portion 44 of the strut 16 by an interference fit (see FIG. 2). The sheath 20 defines a plenum chamber 64 therein, and includes a plurality of side openings 66 which enables air or other surrounding fluids to enter the plenum chamber 64. The sheath 20 receives a generally disk-shaped face plate 60 (see FIG. 1) therein. The face plate 60 may be brazed to an inner surface of the sheath 20, and includes a plurality of front openings 62. Each front opening 62 receives an injector tip therein to enable the output of the injector tips to be sprayed into the combustion chamber 56.

The upper housing 14 and strut 16 each include a central opening 59 and 61, respectively, and the central openings receive a generally cylindrical outer fuel tube 68 therein. The outer fuel tube 68 is preferably generally spaced apart from the strut 16 to form an annular air gap 69 therebetween for insulating purposes. The outer fuel tube 68, in turn, receives a generally cylindrical inner fuel tube 70 therein. The inner fuel tube 70 is received within, spaced apart from, and concentric or coaxial with the outer fuel tube 68.

The multiplex injector 10 includes a seal retainer 72 located in the central opening 59 of the upper housing 14. The seal retainer 72 includes a generally radially-extending opening 74 that is in fluid communication with the input port 52 and the outer fuel tube 68, and a generally axially-extending opening 76 that is in fluid communication with the input port 50 and inner fuel tube 70. FIG. 2 illustrates the inner fuel tube 70 received in the axially-extending opening 76. The seal retainer 72 is preferably attached to the upper ends of the inner 70 and outer 68 fuel tubes, such as by brazing. The seal retainer 72 includes a pair of generally annular grooves or recesses 78 formed on its outer surface, and each groove receives an o-ring 80 therein, such as a fluorocarbon o-ring, to form a seal with the wall of the central opening 59 of the upper housing 14. In this manner, the seal retainer 72 is free to move up and down inside the central opening 59 of the upper housing 14 to accommodate thermal expansion and contraction of various components of the multiplex injector 10.

It may be desired to retain the seal retainer 72 and o-rings 80 below a predetermined temperature to protect the o-rings 80 and ensure the integrity of the o-rings 80. The flow of fuel through the seal retainer 72 helps to cool the seal retainer 72 and maintain the desired temperature of the o-rings. However, additional cooling features, such as active cooling, may be provided in the upper housing 14 to maintain the temperature of the seal retainer 72 (and therefore, the o-rings 80) within the desired temperature range.

The multiplex injector 10 includes a rear plate 82 received inside a lower end of the strut 16, the rear plate 82 including a central orifice 84 and an offset orifice 86 formed therein. The central orifice 84 is in fluid communication with the inner fuel tube 70, and the offset orifice 86 is in fluid communication with the outer tube 68. The rear plate 82 is preferably generally spaced apart from the strut 16 such that an annular air gap 88 is formed between the rear plate 82 and strut 16 for insulation purposes. The rear plate 82 is preferably connected to the strut 16 by brazing. The lower ends of the outer 68 and inner 70 fuel tubes are preferably coupled to the rear plate 82, such as by brazing.

Figure 3:
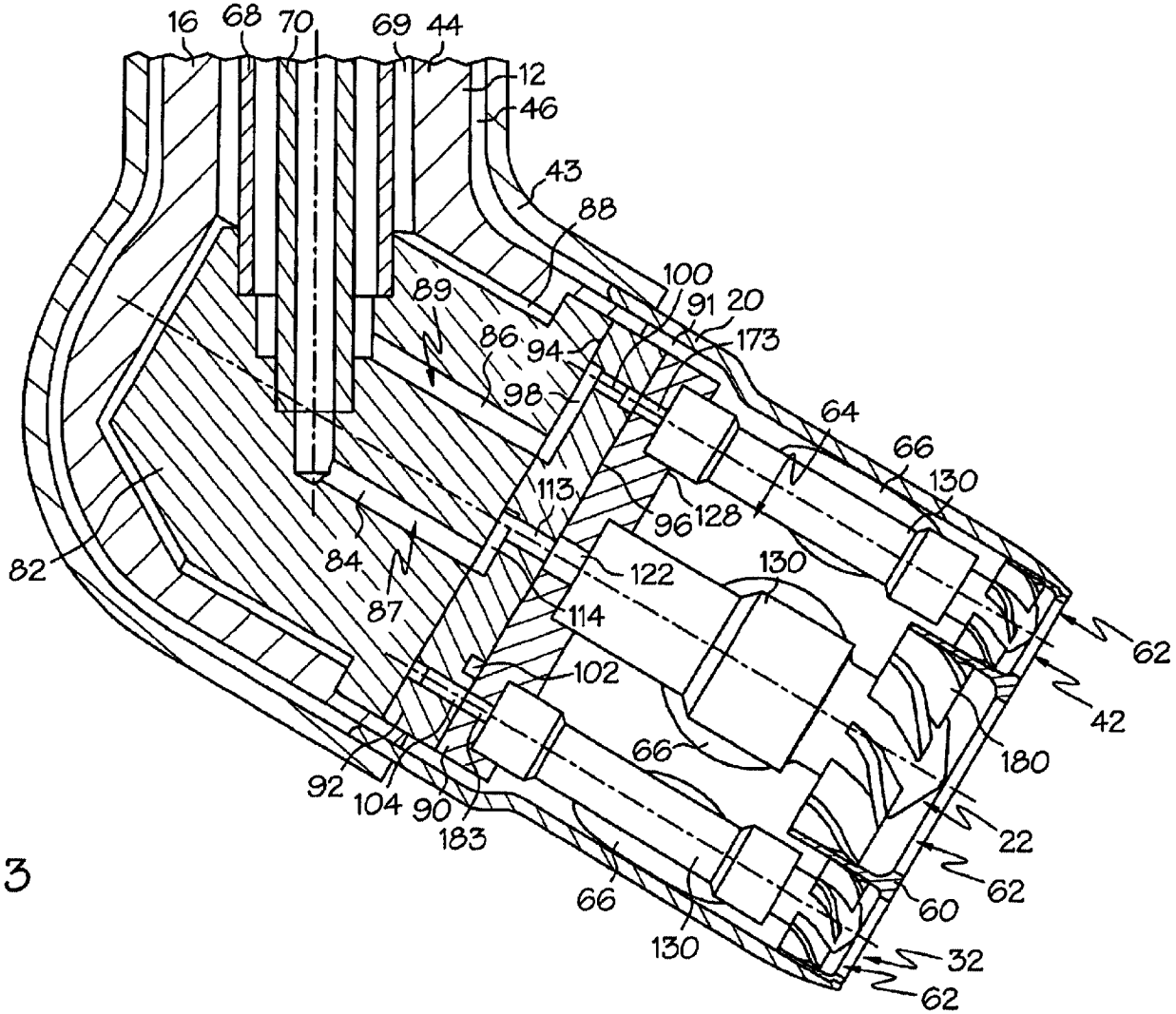
FIG. 3 is a detailed side cross section of a lower portion of the injector of FIG. 2.

As shown in FIG. 3, the multiplex injector includes a front plate 90 and a distributor plate 92 that is located between the front plate 90 and the rear plate 82. Both the front plate 90 and distributor plate 92 are preferably generally spaced apart from sheath 20 to form an annular insulating gap 91 therebetween. The rear plate 82, front plate 90 and distributor plate 92 are together termed a flow divider and divide and route the flow of fuel in the desired manner. The front plate 90, rear plate 82, and distributor plate 92 are preferably aligned and brazed together and include a plurality of internal paths to fluidly couple the inner 70 and outer 68 fuel tubes to the various injector tips 22, 24, 26, 28, 30, 32, 34, 36, 38, 40, 42, as will be described in detail below.

Figure 4:
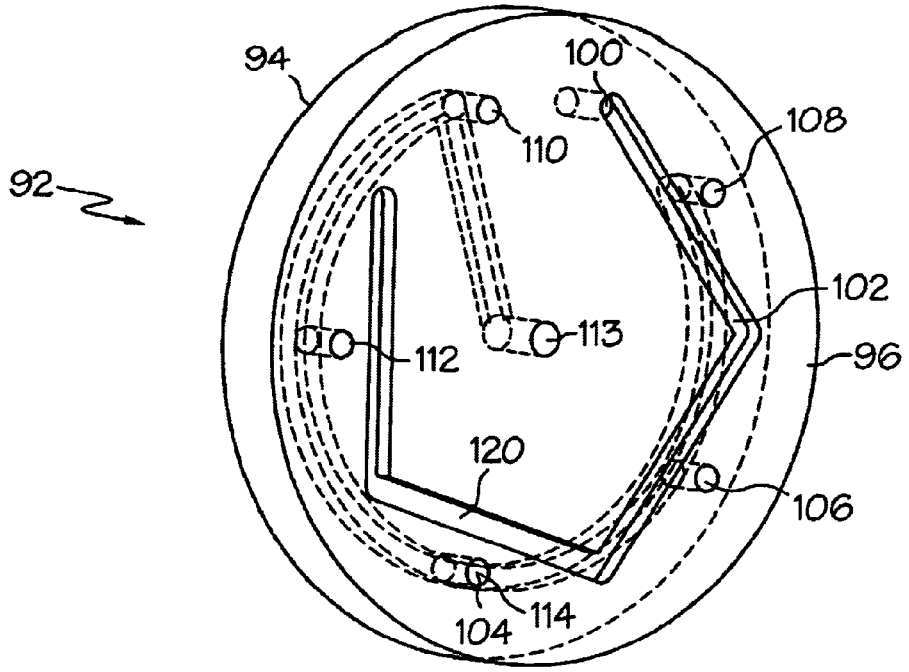
FIG. 4 is a front perspective view of one embodiment of a distributor plate.
Figure 5:
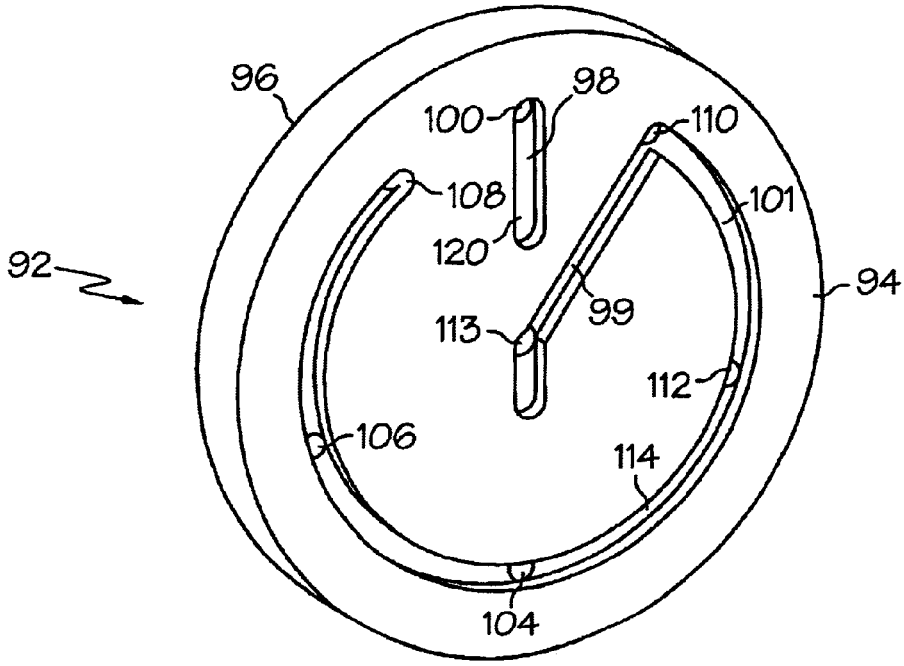
FIG. 5 is a rear perspective view of the distributor plate of FIG. 4.

One embodiment of the distributor plate 92, as shown in FIGS. 4 and 5, includes a rear surface 94 that is in contact with the rear plate 82 and a front surface 96 that is in contact with the front plate 90. As shown in FIG. 5, the rear surface 94 of the distributor plate 92 includes a short groove 98 that is connected to a through hole 100 that extends through the thickness of the distributor plate 92. The through hole 100 is in turn connected to a long, generally pentagonally-shaped groove 102 located on the front side 96 of the distributor plate 92 (FIG. 4). The rear surface 94 of the distributor plate 92 also includes a spur groove 99 and a long circumferential groove 101 (FIG. 5) which extends generally around the perimeter of the rear surface 94. The distributor plate 92 includes a set of through holes 104, 106, 108, 110, 112, 113 that are in fluid communication with circumferential groove 101 and spur groove 99, and that extend through the thickness of the distributor plate 92 to the front surface 96.

In this manner, the distributor plate 92 includes a first fluid delivery line 114 which includes the long groove 101 and spur groove 99 on the rear surface of the distributor plate 92, and the through holes 104, 106, 108, 110, 112, 113. The first fluid delivery line 114 is in fluid communication with the central orifice 84 of the rear plate 82, as well as the inner fuel tube 70. The distributor plate 92 also includes a second fluid delivery line 120 which includes the short groove 98 on the rear surface 94 of the distributor plate 92, the through hole 100 and the long groove 102 located on the front surface 96 of the distributor plate. The second fluid delivery line 120 is in fluid communication with the offset orifice 86 of the rear plate 82, as well as the outer fuel tube 68. The short groove 98 is designed to ensure fluid communication with the offset orifice 86, and may not be required if proper tolerances can be maintained.

Figure 6:
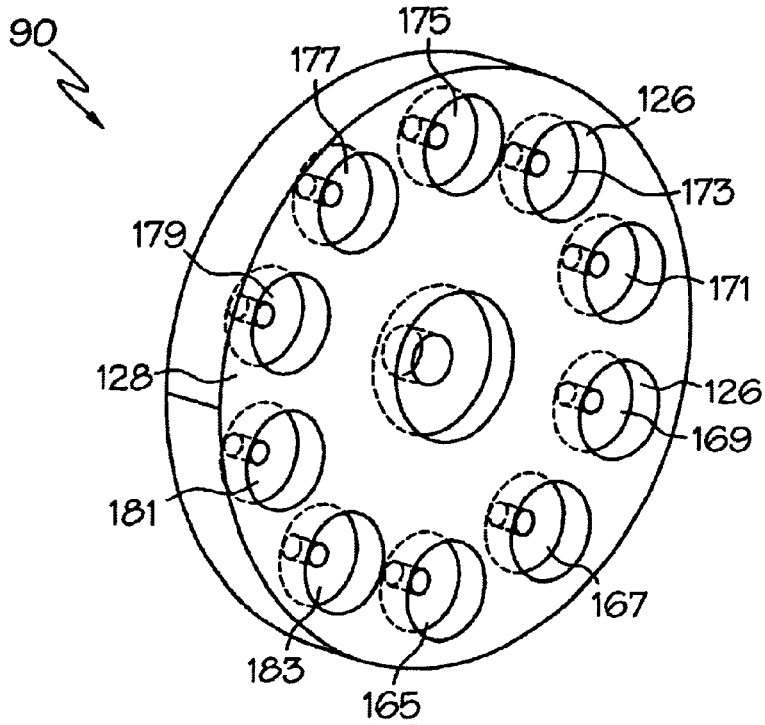
FIG. 6 is a front perspective view of one embodiment of a front plate.
Figure 7:
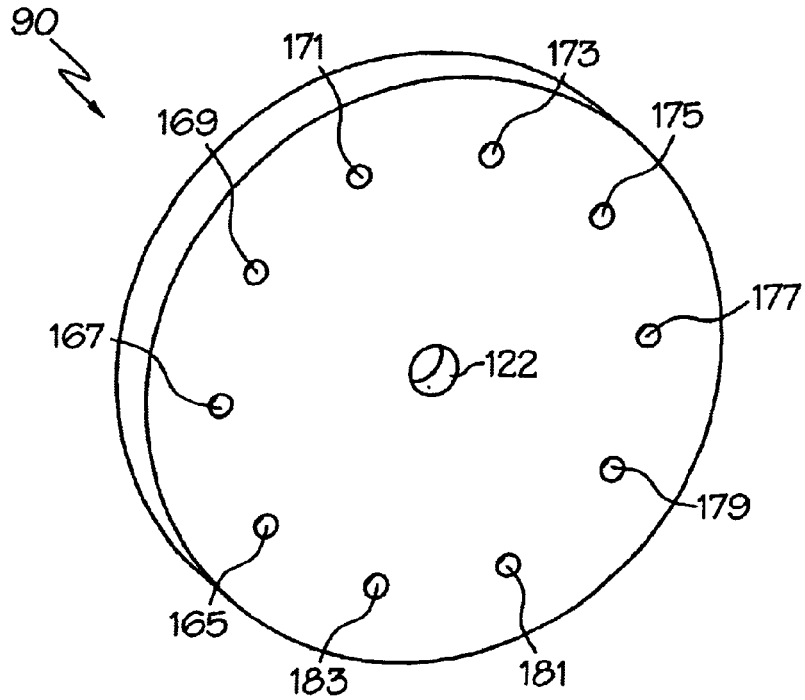
FIG. 7 is a rear perspective view of the front plate of FIG. 6.

As shown in FIGS. 6 and 7, the front plate 90 includes a center opening 122 and a plurality of outer openings 165, 167, 169, 171, 173, 175, 177, 179, 181, 183 located generally around the center opening 122 and adjacent to an outer edge of the front plate 90. Each opening 122, 165, 167, 169, 171, 173, 175, 177, 179, 181, 183 includes a recessed or countersunk portion 126 formed in the front face 128 of the front plate 90. When the front plate 90 is aligned and pressed into contact with the distributor plate 92, each opening 122, 165, 167, 169, 171, 173, 175, 177, 179, 181, 183 is in fluid communication with one of the fluid delivery lines 114, 120 of the distributor plate 92. For example, openings 122, 167, 171, 175, 179, 183 are in fluid communication with the first fluid delivery line 114 (and therefore the inner fuel tube 70), and openings 165, 169, 173, 177, 181 are in fluid communication with the second fluid delivery line 120 (and therefore the outer fuel tube 68).

Returning to FIG. 3, it can be seen that the multiplex injector 10 includes a plurality of fuel cylinders 130 located inside the sheath 20. Each fuel cylinder 130 is coupled to the front plate 90 (such as by brazing) such that an inner end of each cylinder 130 is received in the recessed portion 126 of each opening 122, 165, 167, 169, 171, 173, 175, 177, 179, 181, 183 and therefore in fluid communication with one of the openings of the front plate 90. The other end of each fuel cylinder 130 is coupled to one of the injector tips 22, 24, 26, 28, 30, 32, 34, 36, 38, 40, 42. In this manner, each fuel cylinder 130 delivers fuel from the front plate 90 to the associated injector tip.

Figure 9:
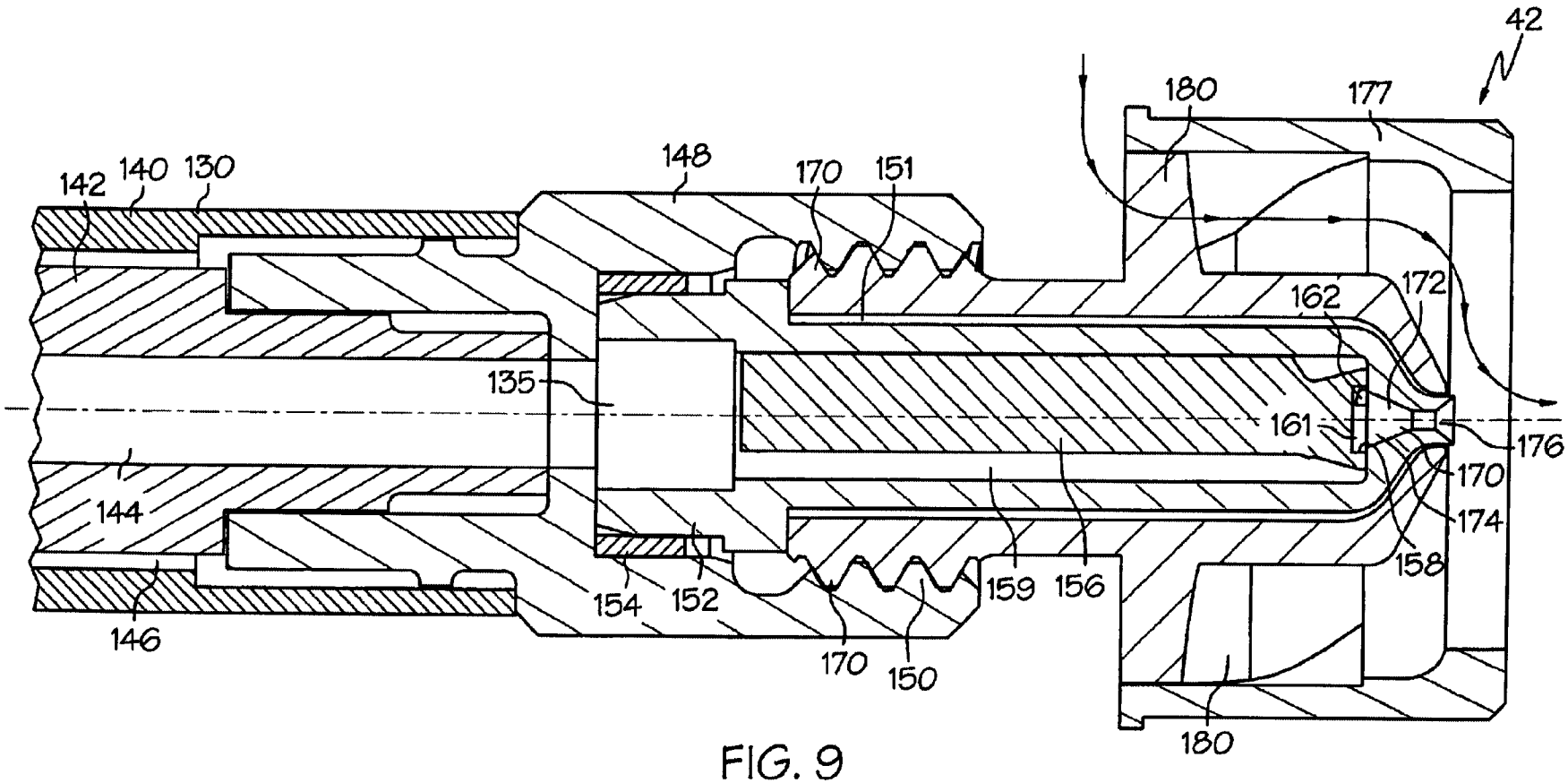
FIG. 9 is a detailed side cross section of an injector tip and fuel cylinder of the injector of FIG. 2.

As shown in FIG. 9, each fuel cylinder 130 includes an outer wall 140 and a fuel delivery channel 142 received therein, the fuel delivery channel 142 having an orifice 144 formed therein. Each delivery channel 142 is generally spaced apart from the outer wall 140 to form an annular insulating gap 146 therebetween. Each fuel cylinder 130 includes a tube adaptor 148 coupled to the inner surface of the outer wall 140 of the fuel cylinder 130. The tube adaptor 148 includes a set of internal threads as indicated at 150. The tube adapter 148 receives a distributor housing 152 therein and a generally cylindrical or diametrical metal seal 154 is preferably located between the tube adaptor 148 and an inner end of the distributor housing 152 to form a seal therebetween. The metal seal 154 is preferably sized to seize both the tube adapter 148 and distributor housing 152 to form an effective seal, and is preferably made of palladium.

Figure 16:
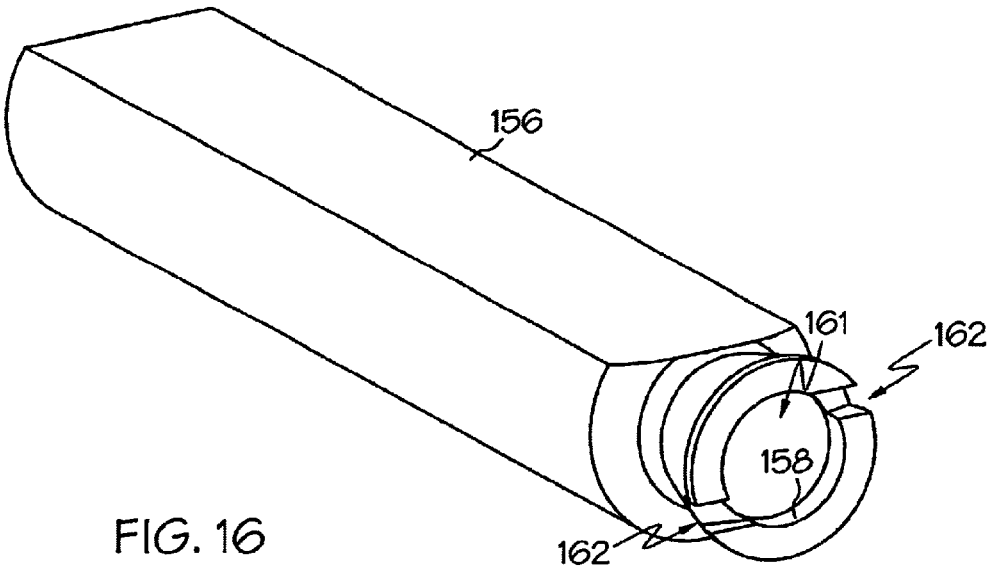
FIG. 16 is a front perspective view of a fuel distributor of FIG. 9.

The distributor housing 152 includes a slab-sided fuel distributor 156 located inside the inner cavity 159 of the distributor housing 152. The fuel distributor 156 is held in place against an inner surface of the distributor housing 152, such as by spot brazing a rear end of the fuel distributor 156 to the distributor housing 152. The fuel distributor 156 includes a counter bore 158 at its front end to form a cavity 161 therein. The fuel distributor 156 includes two or more tangential slots 162 formed in the outer surfaces of the counter bore 158, as shown in FIG. 16. The slots 162 formed in the outer edges of the fuel distributor 156 are slightly offset from a central axis of the fuel distributor 156 in a well-known manner to establish a swirling motion to the fuel that enters the cavity 161.

Each injector tip, generally designated 42 in FIG. 9, can be coupled to the associated tube adaptor 148 by threading the external threads 170 of the injector tip 42 into the internal threads 150 of the tube adaptor 148. When the injector tip 42 is threaded into the tube adaptor 148, the distributor housing 152 is captured and held in place between the injector tip 42 and tube adaptor 148. The injector tip 42 and distributor housing 152 are preferably shaped such that when the injector tip 42 is threaded into the tube adaptor 148, the injector tip 42 is preferably generally spaced away from the distributor housing 152 to form an annular air gap or insulating layer 151 therebetween. Each injector tip is preferably calibrated for optimal performance in spray quality, stability and noise levels before the injector tip is mounted onto the tube adapters 148.

Figure 10:
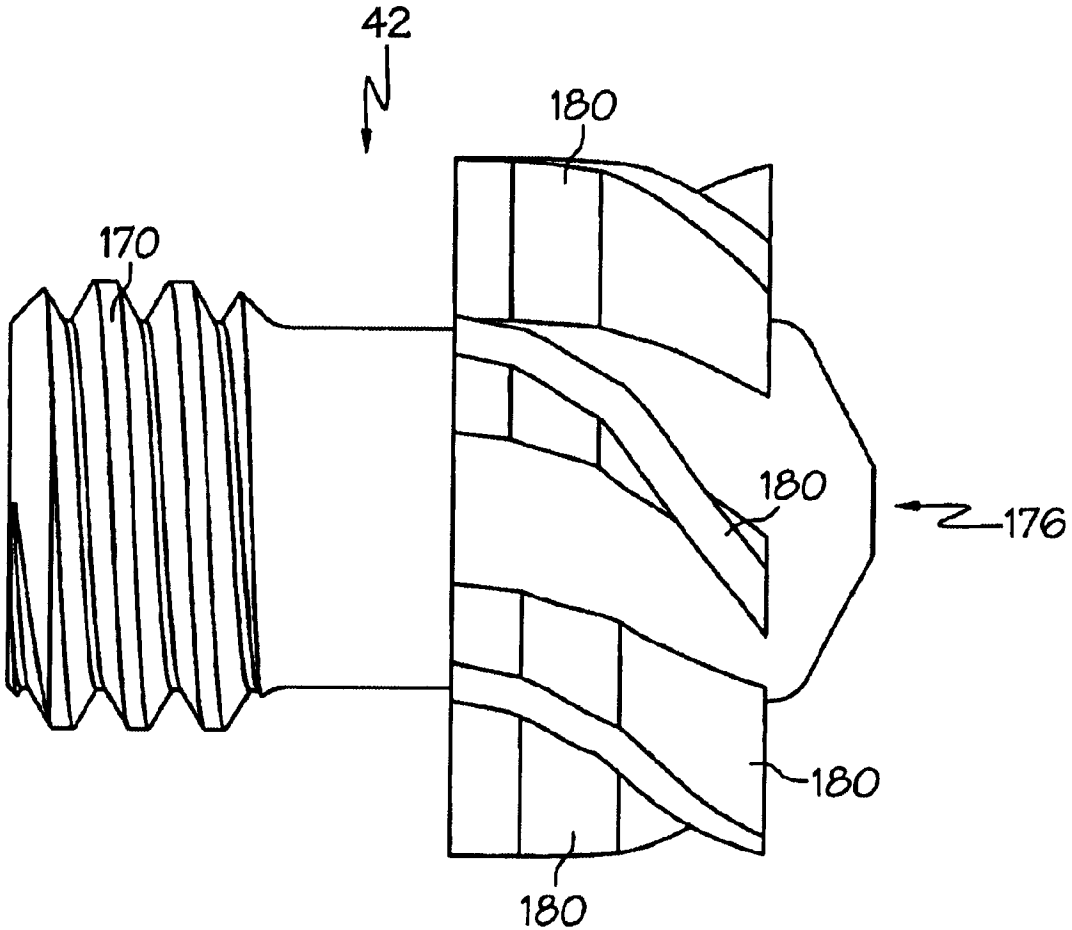
FIG. 10 is a side view of an injector tip of the injector of FIG. 2.

The injector tip 42 preferably includes a discharge orifice or fuel output opening 176 and a conical chamber 172 defined by an angled inner surface. The conical chamber 172 and the cavity 161 together form a swirl chamber 174 located between the discharge orifice 176 and the fuel distributor 156. The discharge orifice is in fluid communication with the swirl chamber 174. As shown in FIG. 10, the injector tip 42 may include a plurality of curved swirler vanes 180 located on an outer surface of the injector tip 42 and adjacent to the discharge orifice 176. The vanes 180 are preferably multi-lead curved swirler vanes that "swirl" or add a rotational velocity component to the surrounding fluid (such as air) that flows over the injector tip 42 and encounters fuel exiting the discharge orifice 176. The atomizer tip 42 may include a cylindrical air cap 177 (FIG. 9) located over the vanes 180 to form a chamber through which the air or other surrounding fluid passes. Each injector tip may include its own air cap 177, or each air cap 177 may be formed as part of the face plate 60. The construction and operation of a conventional simplex atomizer injector tip, such as that shown in FIGS. 9 and 10, are well known in the art.

Figure 8:
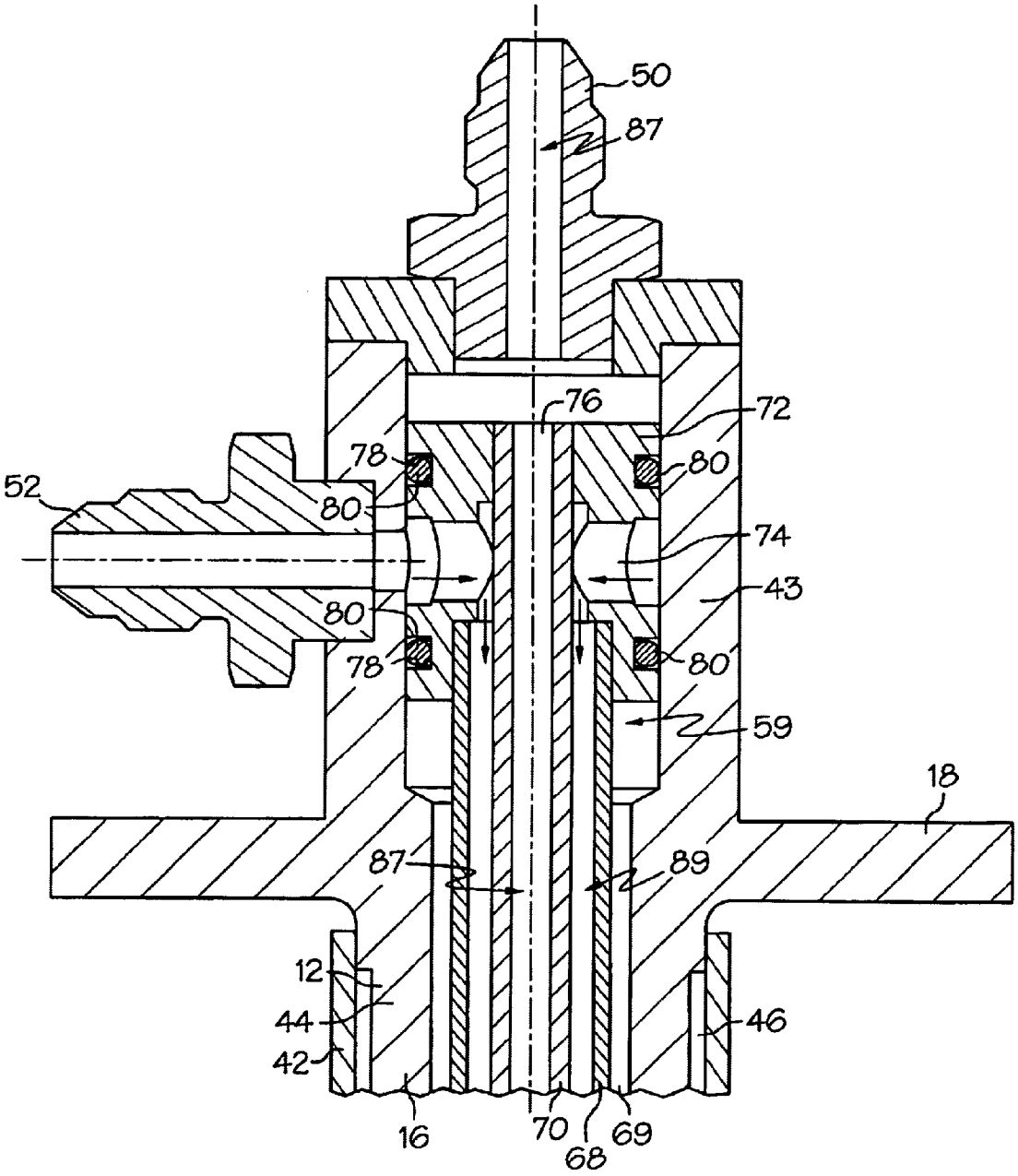
FIG. 8 is a detailed side cross section of an upper portion of the injector of FIG. 2.

In order to operate the multiplex injector 10, a pair of external fuel delivery tubes (not shown) are coupled to the input ports 50, 52 (see FIGS. 1, 2 and 8). The fuel is then delivered from the external fuel delivery tubes to the input ports 50, 52, preferably under pressure by one or more fuel pumps. The fuel flows from the input port 50, through the axially-extending opening 76 in the seal retainer 72, and enters the inner fuel tube 70. Fuel then flows down the inner fuel tube 70 and enters the central orifice 84 of the rear plate 82. The fuel is then routed from the rear plate 82 through the distributor plate 92. For example, as shown in FIGS. 4–7, fuel flowing through the inner fuel tube 70 will flow through the first fluid delivery line 114 (which includes the spur groove 99 and long groove 101 on the rear surface 94 of the distributor plate 92 and the openings 104, 106, 108, 110, 112, 113). The fuel then passes through the associated openings 122, 167, 171, 175, 179, 183 of the front plate 90. Finally, the fuel from the input port 50 is passed through the associated fuel cylinders 130 and associated injector tips 22, 24, 28, 32, 36,40.

As best shown in FIG. 9, the fuel flows through the orifice 144 of the fuel delivery channel 142 of the fuel cylinder 130, and enters the fuel plenum 135. The fuel then exits the fuel plenum 135 and passes through the inner cavity 159 of the distributor housing 152. The fuel then enters the swirl chamber 174 by passing through the slots 162 in the outer surface of the counter bore 158 of the fuel distributor 156. As noted earlier, the milled slots 162 in the counter bore 158 are slightly offset from the center axis of the swirl chamber 174. This causes the fuel to "swirl" in a rotational manner within the swirl chamber 174. In the absence of air or other fluid flow around the injector tip 42, the fuel thereby forms a rotating film over the discharge orifice 176.

Simultaneously, pressurized or compressed air enters the plenum 64 inside the sheath 20 through the side openings 66 formed in the sheath 20. The air may be provided by a compressor, and the air flow is preferably relatively low pressure, low velocity and high volume. The air flow passes through the vanes 180 of each injector tip and exits through the front openings 62 in the face plate 60, as shown by the series of arrows in FIG. 9. The vanes 180 lend a rotational or "swirling" component to the air flow as it passes through the vanes 180. The air flow is preferably rotated in the same direction as the fuel that is swirled inside the swirl chamber 174. The air that flows over each injector tip 22, 24, 28, 32, 36, 40 attacks the rotating liquid fuel film forming on the discharge orifice 176, and "atomizes" the fuel, or breaks the fuel into a myriad of tiny droplets. In this manner, when the compressed air flow interacts with the fuel exiting the discharge orifices 176, a hollow, conical spray of fuel is injected into the combustion chamber 56 by each injector tip. Thus, fuel passed through the input port 50 and exiting the injector tips 22, 24, 28, 32, 36, 40 passes through a first fuel path or first fuel circuit 87.

Simultaneously or independently, fuel can be introduced into the input port 52 and passes through the radially-extending opening 74 of the seal retainer 72 to enter the outer fuel tube 68 (see arrows of FIG. 8). Fuel in the outer fuel tube 68 is then routed to the distributor plate 92 via the offset orifice 86 of the rear plate 82. Next, as shown in FIGS. 4 and 5, fuel flowing from the offset orifice 86 of the rear plate 82 enters the short groove 98 of the second fluid delivery line 120 and flows about the long groove 102 on the front surface 96 of the distributor plate 92. The fuel is then delivered to the openings 165, 169, 173, 177, 181 of the front plate 90 and flows through the associated fuel cylinders 130. In this manner, fuel is delivered to injector tips 26, 30, 34, 38, 42 of FIG. 1. The atomized fuel is then injected into the combustion chamber 56 by atomizer air in the same manner described earlier for the injector tips 22, 24, 28, 32, 36, 40. Thus, the fuel passed through the input port 52 and exiting the injector tips 26, 30, 34, 38, 42 passes through a second fuel path 89 or second fuel circuit.

As can be seen, the multiplex injector 10 of the present invention includes two input ports 50, 52, and the flow of fuel through each input port 50, 52 controls the fuel that is injected into the combustion chamber 56 by the associated set of injector tips. In this manner, the flow rate and/or amount of fuel that is delivered to each set of injector tips can be individually controlled. The first fuel circuit 87 is used to control the flow rates and pressure of the center injector tip and five of the outer injector tips, and the second fuel circuit 89 is used to control the flows rates of the remaining five outer injector tips. Thus, the multiplex injector 10 provides control over which injector tips are activated at any one time, and enables the injector tips to be selectively controlled by turning "on" or "off" selected ones of the injector tips. In this manner, the present invention can provide for varying numbers of fuel staging combinations to optimize engine performance. For example, the central injector 22 may have a slightly larger air effective area and flow rate, as compared to the other injector tips, to distribute more fuel in the central combustion zone. In this manner, the central injector can inject fuel in an area of the combustion chamber that may require a higher fuel-to-air ratio.

Although in the illustrated embodiment the multiplex injector 10 includes two input ports 50, 52, the multiplex injector 10 may also include only a single input port. The flow of fuel inside the injector 10 may then be at least partially diverted into a second fuel circuit by a controllable valve. The multiplex injector 10 may include valves 63, 65 to control fuel flow into each input port 50, 52 (FIG. 2). For example, the injector may include a valve that can be closed to block the flow of fuel to selected ones of the injector tips, and can be opened to allow fuel to flow to the selected ones of the injector tips. The valve may be a normally closed valve that is opened when the fuel pressure reaches a sufficient level. The valve can also be independently controlled by a controller or processor, and opened upon the occurrence of certain events or the detection of certain conditions. When the multiplex injector 10 includes multiple fuel circuits, the injector may include multiple internal valves, if desired. Furthermore, it is not necessary that the multiplex injector include separate fuel circuits. It is within the scope of the invention to provide a plurality of injector tips mounted inside a single injector head, wherein the multiplex injector does not include separate fuel circuits.

The multiplex injector 10 allows the injector tips to be activated individually or as a group. For example, during low power usage, such as ignition and relight condition, less than all of the injector tips (i.e., only injector tips 26, 30, 34, 38, 42) may be activated. When only a few of the injector tips are activated, most of the air flow will pass through the non-activated tips and will not be actively involved in the atomization or combustion processes. In contrast, at full power conditions, all of the injector tips may be activated to produce the most uniform fuel/air mixing for low emissions and low temperature pattern factors. Although each injector tip may have fixed geometry, the multiplex injector, as a whole, provides an effective variable geometry injector in which certain injector tips can be turned on or off. Thus, the multiplex injector of the present invention can achieve low emissions and wide combustion stability for various engine applications, particularly engines that operate at high temperatures and high pressures. Therefore, combustion emissions and stability of engine operations can be improved.

The distributor plate 92 of the present invention delivers fuel to the desired injector tips for best performance. Thus, although the distributor plate 92 illustrated in FIGS. 4 and 5 is designed for use with eleven injector tips (that are divided into two sets of injector tips), the multiplex injector 10 and distributor plate can be modified to include nearly any number of injector tips divided into nearly any number of groups. For example, if desired, the flow of fuel through each of the injector tips 22, 24, 26, 28, 30, 32, 34, 36, 38, 40, 42 could be individually controlled. Thus, the fuel distributor system of the present invention provides flexibility and adaptability to add additional fuel circuits, thereby creating great flexibility in controlling fuel injection. The multiplex injector need only be modified to provide the appropriate hardware, such as a distributor plate, rear plate, fuel tubes and input ports. For complicated fuel staging, it may be necessary to stack several distributor plates adjacent to each other in a laminated stack in order to form the channels required for fuel delivery and cooling purposes.

Figure 11:
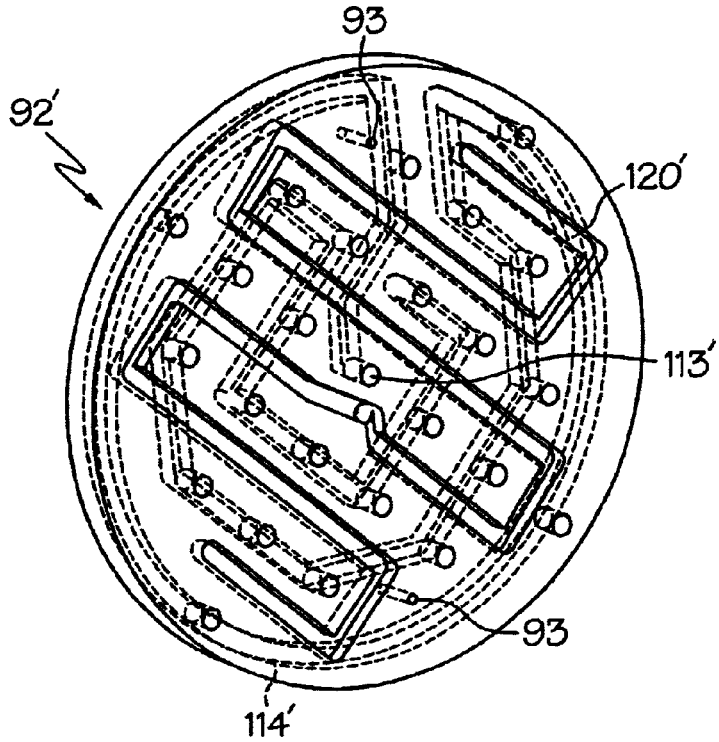
FIG. 11 is a front perspective view of an alternate embodiment of a distributor plate.
Figure 12:
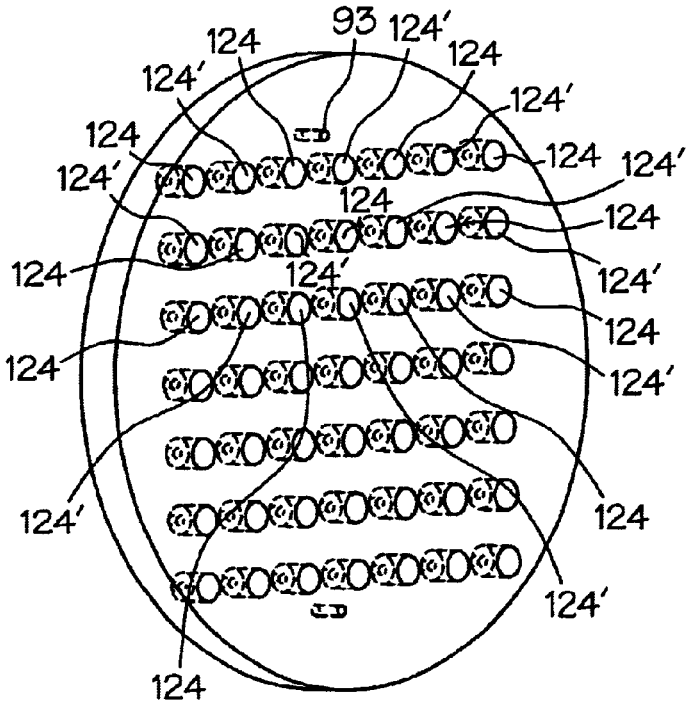
FIG. 12 is a front perspective view of an alternate embodiment of a front plate that may be used with the distributor plate of FIG. 11.

The multiplex injector of the present invention can be used with nearly any number of injector tips. FIGS. 11 and 12 illustrate another embodiment of the invention wherein the distributor plate 92' and front plate 90' shown therein are adapted for use with a 49-tip injector. In the illustrated embodiments, the distributor plate 92' divides the injector tips into two sets of injector tips for separate control. The distributor plate 92' includes a second fluid delivery line 120' that is in fluid communication with the outer fuel tube 70, and includes a groove formed in a zig-zag shape across the front of the distributor plate 92', as well as a through hole. The distributor plate 92' includes a first fluid delivery line 114' that is in fluid communication with the inner fuel tube 68 and includes a groove formed in the back surface of the distributor plate, as well as a plurality of holes. Thus, it can be seen that the first 114, 114' and second 120, 120' fluid delivery lines can be formed as a variety of holes and grooves formed on either side of the distributor plate.

Although in the illustrated embodiment the distributor plate 92 includes two fuel circuits, the injector tips can be divided into any number of individual sets for control, including up to 49 "sets." The distributor plate 90' includes a plurality of openings 124, 124'. In the illustrated embodiment, the openings 124 are controlled by a first fuel circuit and the openings 124' are controlled by a second fuel circuit. In this case, the openings 124, 124' are preferably alternated across the face of the distributor plate 90' in the pattern as shown in FIG. 12 (only part of the pattern being shown in FIG. 12). As shown in FIGS. 11 and 12, the distributor plate 92' and front plate 90' may each include a set of alignment holes 93 through which an alignment pin (not shown) may extend. The alignment holes 93 are preferably arranged such that the alignment pin can only pass through the alignment holes 93 when the plates 90', 92' are located in their desired positions and configurations.

Figure 13:
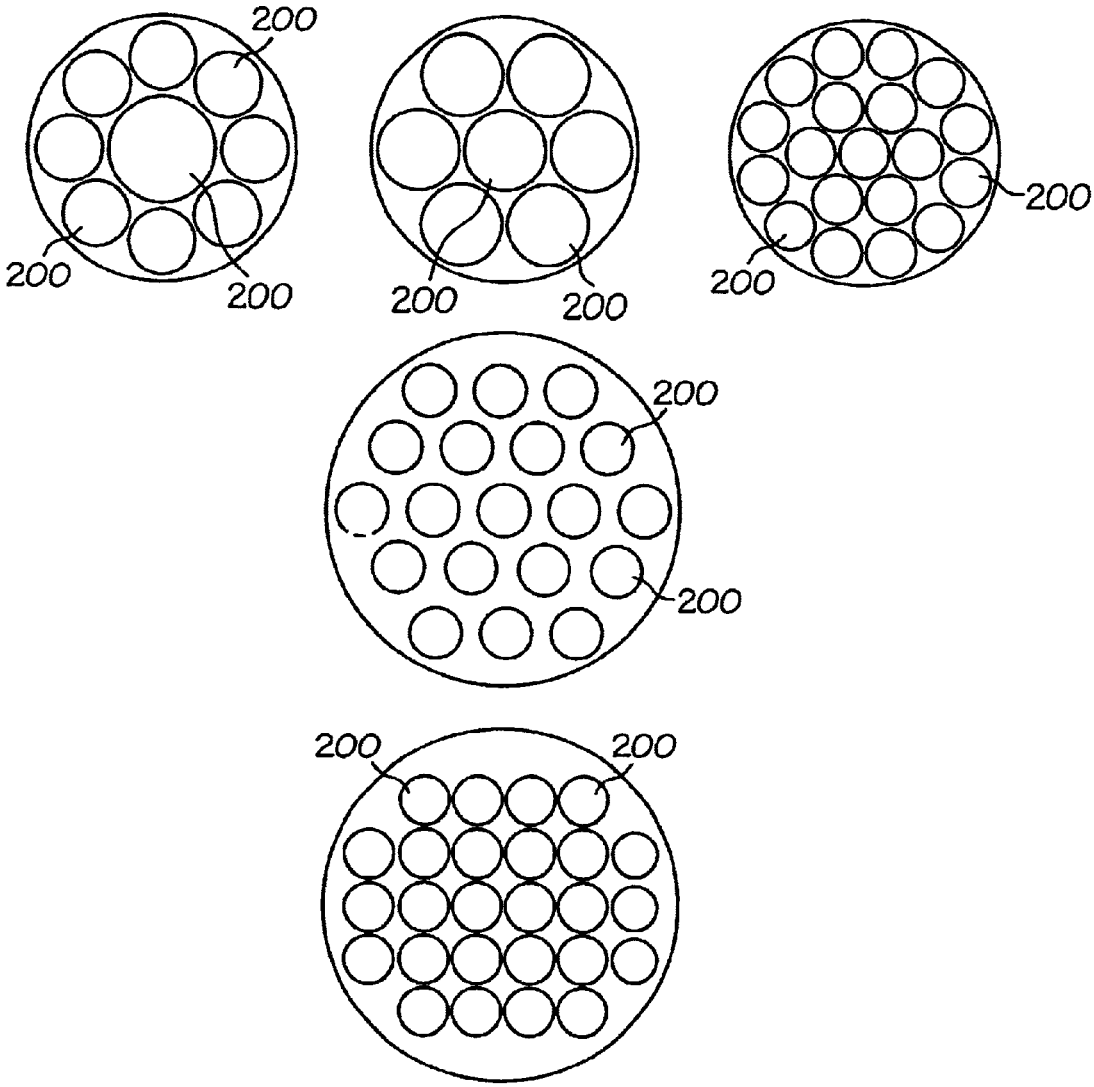
FIG. 13 is a front schematic representation of various arrangements of injector tips.
Figure 14:
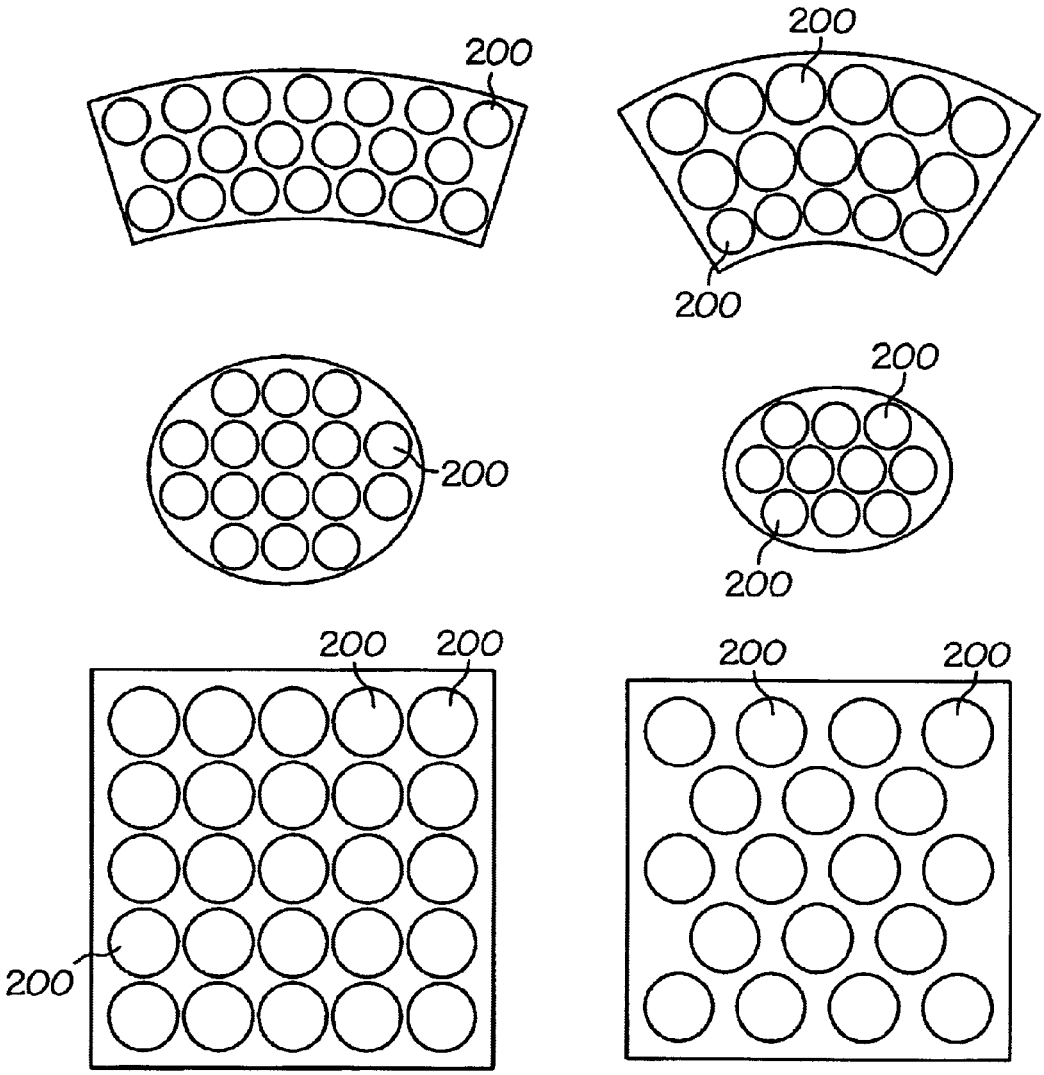
FIG. 14 is a front schematic representation of various arrangements of injector tips.

The multiplex injector 10 of the present invention offers flexibility to produce various spray patterns to match the geometry of the combustion chamber. For example, as shown in FIGS. 13 and 14, the injector tips 200 can be arranged in any of a variety of patterns including but not limited to square, circular, elliptical, and sector shaped. It should be understood that FIGS. 13 and 14 illustrate the shape of the lower tip of the multiplex injector (i.e. a front view of the face plate 60 and associated injector tips). Preferably, in each of the arrangements of the injector tips, the injector tips are arranged within a circular outer shape (i.e., fixed within the disk-like face plate 60) to enable the multiplex injector head to be inserted into a standard sized circular opening in the combustion liner 58. The injector tips may be arranged in various patterns within the outer perimeter of the face plate 60, such as circular (top row of patterns of FIG. 13), staggered (middle pattern of FIG. 13), linear (lower pattern of FIG. 13), or various other patterns. As shown in FIG. 14, the injector tips 200 may be arranged within a sector envelope or fan shaped in a staggered, non-staggered, or various other patterns.

The injector tips of the multiplex injector are preferably simplex air blast atomizer tips, and the spacing between the injector tips is preferably optimized to ensure minimal spray-tospray interaction for best combustion performance. The simplex air blast atomizer tip may be preferred for use with the multiplex injector because simplex air blast atomizers are relatively simple and cheap, and can be made in mass quantities with high precision. However, it should be understood that nearly any atomizer tip or injector tip that converts fuels into sprays or atomized form may be used without departing from the scope of the invention. Furthermore, the air swirler vanes 180 of injector tips may have any of a variety of configurations other than that specifically disclosed herein, such as conventional single-lead helical vanes, multiple-lead swirler vanes, angled holes with discrete air jets, and the like.

As noted earlier, each injector tip can preferably be easily removed or replaced from the atomizer for repair, calibration or replacement by the threaded attachments 150, 170. This enables the injector tips to be easily removed or replaced as desired. Furthermore, because each injector tip is removably coupled to the multiplex injector, various types and sizes of injector tips can be incorporated into a single multiplex unit, with each injector tip having different flow capacities and spray characteristics, if desired, to conform the injector to the various conditions of the flow environment. Furthermore, depending upon the combustion chamber configuration and flow areas, the injector tips can provide different fuel flow numbers and air effective areas to accommodate for the need to deploy varying fuel/air mixtures at varying regions within the combustion chamber. For example, the delivery of fuel to one set of injector tips may be restricted compared to the fuel flow at another injector tip by, for example, reducing or increasing the size of the fuel cylinders or other paths of fuel flow within the multiplex injector.

The multiplex injector may include several features to enhance the high-temperature performance of the multiplex injector. For example, as noted earlier, the multiplex injector may include external heat shielding. Furthermore, the injector may include various other air gaps or insulating layers 46, 69, 88, 91, 146, 151 to further insulate the injector from surrounding high temperatures. As noted earlier, the seal retainer 72 is movable to accommodate thermal expansion of various components in the multiplex injector, which helps the injector to operate effectively at elevated temperatures. A carbon-resistant coating or anti-carbon coating is a preferably applied to all wetted surfaces or fuel passages inside the injector to reduce carbon or coke formation in the various internal passages of the multiplex injector.

Using the present invention, the air flow and/or fluid flow through the various injector tips may be arranged in various manner to provide for favorable aerodynamics to reduce acoustic noise and increase flow stability. For example, in many conventional injectors, the swirling direction of the atomized fuel of the injector tips is typically in the same direction for each of the injector tips. However, in the present invention the fuel spray exiting selected injector tips may be opposite in direction to the fuel spray of others of the injector tips to create a counter-swirling flow (by "fuel spray" it is meant the fuel/air combination that is sprayed from the injector tips).

Figure 15A:
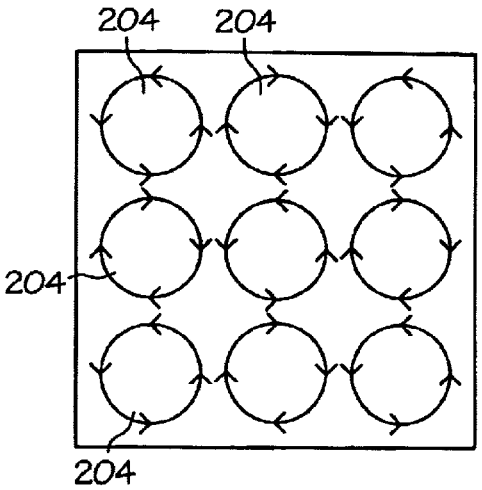
FIG. 15A is a front schematic representation of a flow pattern of the output of an injector.
Figure 15B:
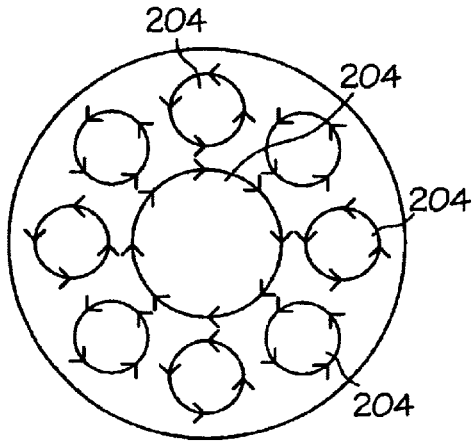
FIG. 15B is a front schematic representation of another flow pattern of the output of an injector.

For example, as shown in FIG. 15A, each of the adjacent injector tips 204 may have opposite output spray swirl directions. As shown in FIG. 15B, the central injector tip 202 may have an output spray swirl in a first direction, and the remaining outer injector tips 204 may have an output spray swirl in the opposite direction. In a linear configuration of injector tips, alternating the output spray swirl directions on a row-by-row basis may be desired. Various other configurations of counterswirling may be used with the patterns of counterswirling being nearly limitless.

The differing output spray swirl directions can be created by changing various features within each injector tip, such as the curvatures of the vanes 180 and/or orientation of the slots 162. The counter swirling arrangement may provide for enhanced fuel/air uniformity in the primary zone, which in turn can provide a more favorable fuel distribution profile near the exit of the combustion chamber and reduce acoustic noise. The counterswirling of the atomized air may work best for relatively small injector tips (i.e. having a size of less than about 0.5") and helps to improve mixing on a local basis. More particularly, localized counterswirling of the spray output of adjacent injector tips may provide an extended fuel-to-air operating range to the multiplex injector.

Furthermore, the injector tips may be configured such that the swirling direction of the fuel in the swirl chamber 174 is opposite to the swirling direction of the air that flows over the vanes 180.

The multiplex injector of the present invention may be adapted for active control or pulse injection to regulate combustion noise or instability. The multiplex injector may also be used in electronically controlled fuel injection where feedback sensors are used to regulate timing and the amount of fuel injection.

Having described the invention in detail and by reference to the preferred embodiments, it will be apparent that modification and variations thereof are possible without departing from the scope of the invention.

What is claimed is:

1. A multiplex injector system comprising:

an injector head;

a first fuel path located in said injector head;

a first set of injector tips in fluid communication with said first fuel path, said first set of injector tips being directly or indirectly rigidly coupled to said injector head and including at least one first injector tip;

a second fuel path located in said injector head; and a second set of injector tips being directly or indirectly rigidly coupled to said injector head and in fluid communication with said second fuel path, said second set of injector tips including at least two second injector tips, wherein a flow of fuel in each of said first and second fuel paths can be selectively controlled to control the flow of fuel through said first and second sets of injector tips.

2. The multiplex injector system of claim 1 wherein said first and second set of injector tips are simplex airblast atomizer tips.

3. The multiplex injector system of claim 2 wherein each injector tip includes a swirl cavity such that fuel exiting said injector tip has a rotational velocity component.

4. The multiplex injector system of claim 1 wherein said first set of injector tips includes a centrally located injector tip, and wherein said second set of injector tips includes a plurality of injector tips located about said centrally located injector tip.

5. The multiplex injector system of claim 4 wherein said first set of injector tips further includes a plurality of injector tips located about said centrally located injector tip.

6. The multiplex injector system of claim 1 further comprising a distributor plate located inside said injector head, said distributor plate being in fluid communication with said first and second fuel paths and including a plurality of internal channels to couple said first fuel path to said first set of injector tips and said second fuel path to said second set of injector tips.

7. The multiplex injector system of claim 6 wherein said distributor plate includes a rear surface, a front surface, a first fluid delivery line including a groove on said rear surface and a plurality of through holes, said first fluid delivery line being in fluid communication with said first fuel path, and a second fluid delivery line including a through hole and a groove on said front surface, said second fluid delivery line being in fluid communication with said second fuel path.

8. The multiplex injector system of claim 1 further comprising a faceplate coupled to said injector head, said faceplate includes a plurality of openings, each opening receiving one of said injector tips therein, and wherein said multiplex injector includes a plurality of openings located adjacent to said faceplate to enable surrounding fluids to enter into said injector head.

9. The multiplex injector system of claim 1 wherein said at least one of said fuel paths is defined at least partially by a fuel tube, and wherein said injector head includes a throat portion that is generally spaced apart from said fuel tube to define an insulating gap between said throat potion and said fuel tube.

10. The multiplex injector system of claim 1 wherein said second fuel path is defined at least partially by a second fuel tube, and wherein said first fuel path is defined at least partially by a first fuel tube generally located inside and generally coaxial with said second fuel tube.

11. The multiplex injector system of claim 10 further comprising a rear plate located adjacent to an end of each fuel tube and including two orifices therein, each orifice being in fluid communication with one of said fuel tubes, and a distributor plate located adjacent to said rear plate having two fluid delivery lines formed therein, each fluid delivery line being in fluid communication with one of said orifices of said rear plate.

12. The multiplex injector system of claim 11 further comprising a front plate located adjacent to said distributor plate and including a plurality of openings, each opening being in fluid communication with one of said fluid delivery lines of said distributor plate.

13. The multiplex injector system of claim 12 further comprising a plurality of fuel cylinders, each fuel cylinder being in fluid communication with one of said openings of said front plate at one end and with an injector tip at another end such that each fuel cylinder can deliver fuel from said front plate to one of said injector tips.

14. The multiplex injector system of claim 10 wherein said injector head includes a central opening defining an inner wall and wherein said injector system further includes a seal retainer coupled to at least one of said first and second fuel tubes, said seal retainer being located in said central opening and sealingly yet displaceably engaging said inner wall of said injector head.

15. The multiplex injector system of claim 14 wherein said seal retainer includes at least one groove formed therein and receiving an O-ring therein, said O-ring engaging said inner wall to form a seal therewith.

16. The multiplex injector system of claim 10 further comprising a first input port coupled to said injector head and in fluid communication with said first fuel tube and a second input port coupled to said injector head and in fluid communication with said second fuel tube.

17. The multiplex injector system of claim 10 wherein said injector head includes a throat portion that receives said second fuel tube therein and that is generally spaced apart from said second file tube to define an annular insulating gap between said throat portion and said second fuel tube.

18. The multiplex injector system of claim 1 wherein said injector head includes an annular insulating gap located adjacent an outer surface of said injector head to thermally insulate the inner components of said injector bead.

19. The multiplex injector system of claim 1 wherein each injector tip is removably coupled to said injector head.

20. The multiplex injector system of claim 19 wherein each injector tip is threadedly coupled to said injector head.

21. The multiplex injector system of claim 19 wherein at least part of each injector tip is generally spaced away from at least part of said injector head to form an annular insulating gap therebetween.

22. The multiplex injector system of claim 21 wherein said injector head includes a plurality of tube adapters located therein, and wherein each injector tip is threadedly coupled to an associated tube adapter, and wherein said injector includes a plurality of generally cylindrical metal seals, each seal being located between an inner end of each injector tip and the associated tube adapter.

23. The multiplex injector system of claim 1 wherein each injector tip includes a discharge orifice and is shaped such that when fuel is introduced into said injector tip in the presence of pressurized surrounding fluid said fuel exits said discharge orifice in a spray.

24. The multiplex injector system of claim 1 further comprising an engine having a combustion chamber, and wherein said each injector tip is shaped and located to inject fuel into said combustion chamber in a spray form.

25. The multiplex injector system of claim 1 wherein at least one injector tip of said set of first and second injector tips is shaped to inject fuel having a rotational velocity component in a first direction, and wherein another injector tip of said set of first and second injector tips is shaped to inject fuel having a rotational velocity component in a second direction opposite to said first direction.

26. The multiplex injector of claim 1 wherein each injector tip includes a set of vanes located thereon to guide fluid flowing over the injector tip.

27. The multiplex injector of claim 1 further comprising a face plate located in a lower end of said injector bead, said face plate including a plurality of openings formed therein, and wherein each injector tip is located in one of said openings.

28. The multiplex injector of claim 1 wherein said first and second sets of injector tips each include a plurality of injector tips.

29. The injector system of claim 1 wherein the flow of fuel through said first and second fuel paths can be independently controlled.

30. The injector system of claim 29 wherein fuel can be allowed to flow through said first fuel path to said first set of injector tips and simultaneously blocked from flowing through said second fuel path to said second set of injector tips, and wherein fuel can be allowed to flow through said second fuel path to said second set of injector tips and simultaneously blocked from flowing through said first fuel path to said first set of injector tips.

31. The injector system of claim 1 wherein said injector head includes an end opening which generally closely receives said first and second set of injector tips therein.

32. The injector system of claim 1 wherein said injector head is shaped to be coupled to a combustion chamber.

33. The injector system of claim 1 further including a combustion chamber, and wherein said injector head is coupled to said combustion chamber and said injector head is located such that said first and second set of injector tips can spray fuel into said combustion chamber.

34. The injector system of claim 1 wherein said first and second sets of tips are rigidly coupled said injector head.

35. The injector system of claim 1 wherein said first and second sets of injector tips are arranged to spray fuel into a common combustion zone.

36. A multiplex injector comprising:

an injector head;

a first fuel path located in said injector head;

a first set of injector tips located in said injector head and in fluid communication with said first fuel path, said first set of injector tips including a plurality of injector tips;

a second fuel path located in said injector head; and a second set of injector tips located in said injector head and in fluid communication with said second fuel path, said second set of injector tips including a plurality of injector tips, wherein the flow of fuel in said first and second fuel paths can be selectively controlled to control the flow of fuel through said first and second sets of injector tips.

37. The injector system of claim 36 wherein the flow of fuel through said first and second fuel paths can be independently controlled.

38. The injector system of claim 36 wherein fuel can be allowed to flow through said first fuel path to said first set of injector tips and simultaneously blocked from flowing through said second fuel path to said second set of injector tips, and wherein fuel can be allowed to flow through said first fuel path to said first set of injector tips and simultaneously blocked from flowing through said second fuel path to said second set of injector tips.

39. The injector system of claim 36 wherein said injector head includes an end opening which generally closely receives said first and second set of injector tips therein.

40. The injector system of claim 36 wherein said injector head is shaped to be coupled to a combustion chamber.

41. The injector system of claim 36 further including a combustion chamber, and wherein said injector head is coupled to said combustion chamber and said injector head is located such that said first and second set of injector tips can spray fuel into said combustion chamber.

42. A method for injecting fuel into a combustion chamber comprising the steps of:

providing a multiplex injector including an injector head, a first fuel path located in said injector head, a first set of injector tips being directly or indirectly rigidly coupled to said injector head and in fluid communication with said first fuel path, a second fuel path located in said injector head, and a second set of injector tips being directly or indirectly rigidly coupled to said injector head and in fluid communication with said second fuel path, said first set of injector tips including at least one tip and said second set of injector tips including at least two tips; and selectively causing fuel to flow through said first and second fuel paths such that said fuel is corresponding selectively injected through said first and second set of injector tips into said combustion chamber.

43. The method of claim 42 wherein the causing step includes selectively causing fuel to flow through said first and second feel paths such that the flow of fuel through said first and second fuel path is independently controlled.

44. The method of claim 42 wherein the causing stop includes causing fuel to flow through said first fuel path to said first set of injector tips and simultaneously blocking flow through said second fuel path to said second set of injector tips, and subsequently causing fuel to flow through said second fuel path to said second set of injector tips and simultaneously blocking flow through said first fuel path to said first set of injector tips.

45. The method of claim 42 wherein said injector head includes an end opening which generally closely receives saint first and second set of injector tips therein.

46. The method of claim 42 wherein said injector head is shaped to be coupled to a combustion chamber.

47. The method of claim 42 further comprising the step of, after said providing step and before said causing step, coupling said injector head to a combustion chamber such that said first and second set of injector tips can spray fuel into said combustion chamber.

48. A multiplex injector system comprising:

an injector head;

a first fuel path located in said injector head and defined at least partially by a first fuel tube;

a first set of injector tips located in said injector head and in fluid communication with said first fuel path, said first set of injector tips including at least one first injector tip;

a second fuel path located in said injector head and defined at least partially by a second fuel tube, wherein said first fuel tube is generally located inside and generally coaxial with said second fuel tube; and a second set of injector tips located in said injector head and in fluid communication with said second fuel path, said second set of injector tips including at least one second injector tip, wherein a flow of fuel in each of said first and second fuel paths can be selectively controlled to control the flow of fuel through said first and second sets of injector tips.

49. A multiplex injector system comprising:

in injector head;

a first fuel path located in said injector head;

a first set of injector tips located in said injector head and in fluid communication with said first fuel path, said first set of injector tips including at least one first injector tip;

a second fuel path located in said injector head; and a second set of injector tips located in said injector head and in fluid communication with said second fuel path, said second set of injector tips including at least one second injector tip, wherein a flow of fuel in each of said first and second fuel paths can be selectively controlled to control the flow of fuel through said first and second sets of injector tips, wherein said first and second sets of injector tips each include a plurality of injector tips.

50. A multiplex injector system comprising:

an injector head;

a first fuel path located in said injector head;

a first set of injector tips being directly or indirectly rigidly coupled to said injector head and in fluid communication with said first fuel path, said first set of injector tips including at least one first injector tip;

a second fuel path located in said injector head; and a second set of injector tips being directly or indirectly rigidly coupled to said injector head and in fluid communication with said second fuel path, said second set of injector tips including at least two second injector tips, wherein a flow of fuel in each of said first and second fuel paths can be selectively and independently controlled to control the flow of fuel through said first and second sets of injector tips.

51. A multiplex injector system comprising:

an injector head;

a sheath coupled to said injector head;

a first fuel path located in said injector head;

a first set of injector tips located in said sheath and in fluid communication with said first fuel path, said first set of injector tips including at least one first injector tip;

a second fuel path located in said injector head; and a second set of injector tips located in said sheath and in fluid communication with said second fuel path, said second set of injector tips including at least one second injector tip, wherein a flow of fuel in each of said first and second fuel paths can be selectively controlled to control the flow of fuel through said first and second sets of injector tips.

52. The injector system of claim 51 wherein one of said first and second sets of injector tips includes only a single injector tip, and the other one of said first and second sets of injector tips includes a plurality of injector tips.

53. The injector system of claim 51 wherein both of said first and second sets of injector tips include only a single injector tip.

* * * * *

UNITED STATES PATENT AND TRADEMARK OFFICE

CERTIFICATE OF CORRECTION

PATENT NO. : 6,755,024 B1 
DATED : June 29, 2004
INVENTOR(S) : Chien-Pei Mao, John Earl Short and Neal A. Thomson It is certified that error appears in the above-identified patent and that said Letters Patent is hereby corrected as shown below:

Column 11,
Line 48, “potion” should read -- portion --;

Column 12,
Line 67, “bead” should read -- head --;

Column 14,
Line 22, “feel” should read -- fuel --;
Line 24, “stop” should read -- step --;
Line 34, “saint” should read -- said --.

Signed and Sealed this

Fourth Day of January, 2005

JON W. DUDAS
*Director of the United States Patent and Trademark Office*